United States Patent [19]

Strutz et al.

[11] 4,010,915

[45] Mar. 8, 1977

[54] PROCESS FOR THE CONTROL OF YARN TENSION

[75] Inventors: Hans-Jürgen Strutz; Ingolf Jacob, both of Bobingen, Germany

[73] Assignee: Hoechst Aktiengesellschaft, Frankfurt am Main, Germany

[22] Filed: May 13, 1975

[21] Appl. No.: 577,042

[30] Foreign Application Priority Data

May 18, 1974 Germany ..... 2424302

[52] U.S. Cl. ..... 242/147 R; 28/72.14

[51] Int. Cl.[2] ..... B65H 59/26

[58] Field of Search ..... 242/147 R, 147 A, 147 M, 242/149, 150, 153, 154, 155, 45; 28/72.14

[56] References Cited

UNITED STATES PATENTS

| | | | |
|---|---|---|---|
| 2,771,635 | 11/1956 | Munch | 242/154 UX |
| 3,080,132 | 3/1963 | Fisher et al. | 242/154 |
| 3,300,161 | 1/1967 | Hermanns | 242/154 |
| 3,394,439 | 7/1968 | McIntyre | 242/154 X |
| 3,408,832 | 11/1968 | Abe et al. | 242/154 X |

*Primary Examiner*—Stanley N. Gilreath
*Attorney, Agent, or Firm*—Connolly and Hutz

[57] ABSTRACT

A yarn brake is arranged in the direction of the traveling yarn after the section where the yarn tension has to be kept constant, and the yarn tension is measured before this brake. The yarn is fed to and drawn off from the brake at a substantially constant speed. The control, contrary to the hitherto known processes, has to be carried out inversely, that is, for example, when the measuring feeler signals a rise in the yarn tension in the section to be controlled, the braking effect of the brake has to be increased until the set value of yarn tension in this particular section is attained again. Correspondingly, the braking effect has to be decreased when the yarn tension measured is too low.

3 Claims, 2 Drawing Figures

PROCESS FOR THE CONTROL OF YARN TENSION

Figure 1:
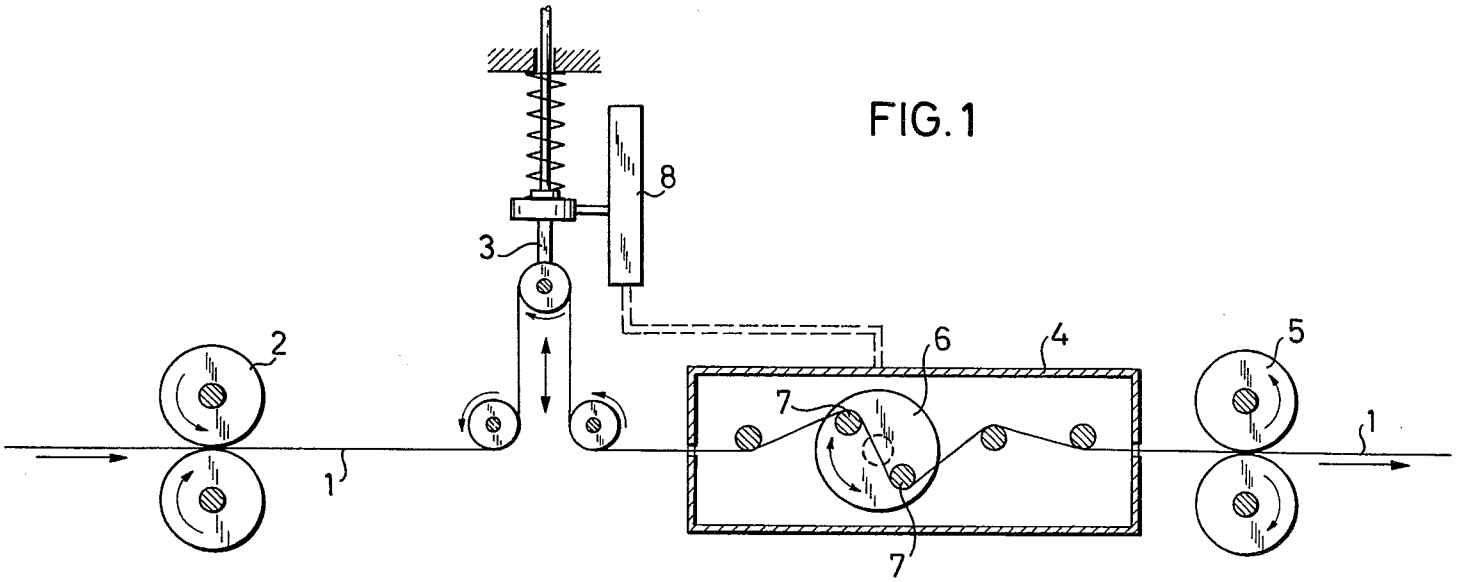

The present invention relates to a process for the control of yarn tension and, preferably, a process for maintaining a constant yarn tension, especially the yarn tension during the separation of yarn from crimped yarn packages.

While manufacturing and processing yarns and threads, a constant yarn tension is often required which should be maintained also in the case where the stretch, the yarn/metal friction, the shrinkage or the crimp of the yarns vary.

In order to solve this problem, it is known to use yarn brakes, for example disk or finger brakes connected with a feeler which measures the tension of the yarn and signals when the yarn tension exceeds the given tolerance limit. Control or maintenance of a constant yarn tension is possible by means of such kind of feeler which either gives a corresponding brake signal or activates the brake directly in order to correct the yarn tension. Such a device is for example described in German Auslegeschrift No. 1,303,823, in which device the yarn tension feeler measuring the yarn tension after the yarn has passed the brake activates mechanically the disk brake and thus controls and maintains a constant yarn tension.

This type of maintaining a constant tension of a traveling yarn or thread cannot be applied in many cases, either because the tension has to be maintained constant in the section of the traveling yarn directly behind a feeder device, or because geometric reasons such as narrow space, or the sensitivity of the yarn do not allow the use of a brake at this moment. Moreover, the use of any brake causes an increase of yarn tension after the brake. For example, the yarn tension $S_2$ of a yarn after the brake, such as a finger brake working according to the principle of rope friction, corresponds to the following equation $$S_2 = R \cdot S_1$$

where $R$ is the braking factor and $S_1$ the yarn tension before the brake. Also in the case of a disk brake, the yarn tension after the brake device is always higher than the tension of the yarn before entering the brake. Such brake devices fail in such cases where the yarn tension has to be maintained constant at a very low level, that is, for example, a tension being insufficient to pull off the crimp of a textured yarn.

It is known that the tension of yarns and threads can be maintained constant also in cases where, at a certain place, brakes cannot be used or only with great difficulties. This is possible by means of forwarding the yarn via transport devices the speed of which may be controlled relative to the tension of the yarn between the transport devices. Such apparatus are for example described in German Auslegeschrift No. 1,957,782 and U.S. Pat. No. 3,091,912, column 6, lines 16 through 19, and the corresponding FIGS. 6 and 7. However, control of yarn tension by means of the speed of feeder devices before and/or after the distance where the yarn is kept in constant tension requires great technological expenditure, especially in the case where such control devices are to be applied in machines comprising several devices of the same kind, such as false-twist texturizing plants, described for example in the above U.S. Patent, FIGS. 6 and 7. In such plants it is usual to provide up to 100 texturing sections of a machine with identical godets and take-off devices which are all driven by means of a common drive. The tension of the yarn, when it passes over the second heater, can be only controlled if the wind-up speed of each single texturizing section can be adjusted individually.

Apart from the considerable technological expenditure necessary in the case of yarn tension control by means of the speed of the feeder devices, there is still another problem: because of different series-connected processes of treatment, it is often impossible to change the corresponding speeds of transport devices such as godets, since otherwise the residence times of the yarn in these process steps would be inadmissibly altered. In the case of thermal treatment of yarn, for example, a constant residence time in such a zone of treatment is absolutely required in order to obtain a uniform yarn quality which is distinguished by uniform dyeability, shrinkage, crimp etc. .

Special problesm arise for example during the separation of hot crimped yarn from yarn packages, as obtained for example according to the process of German Offenlegungsschrift No. 2,155,094. In order to maintain a constant residence time it is necessary to draw off the crimped yarns at constant speed from the stufferbox. The simultaneous separation of the hot yarns from the package has to be carried out at a strictly constant yarn tension since otherwise the still hot yarns become irreversibly uneven.

Certainly, processes are known where the yarn package is cooled in a cooling zone connected with the fixing zone, as described for example in French Patent No. 1,279,122. The cooling time of a tightly packed crimped yarn package, however, is considerably longer than the cooling time of a drawn yarn. At high processing speeds, the cooling zone for a crimped yarn package has to be very long, which complicates handling of the yarn.

It is furthermore known to cool the stuffed yarn package on a conveyor belt and to separate then the cold and thus less sensitive yarns (German Offenlegungsschrift No. 2,151,558). Also in this case, long cooling times occur. Moreover, it has been observed that, at feeding speeds of more than about 1000 m/min to the stufferbox, separation of the stored yarn from a yarn package causes disturbances of the course of operations. Also in the case of less speed it is advantageous to separate the yarn from a yarn package in hot state. During the separation of the yarns from the hot yarn package, the crimping values may be influenced by a corresponding choice of the yarn tension if a possibility is found to separate the hot yarn package under constant tension, that is, separation tension. This possibility would furnish a further process parameter for influencing the crimp of the final material.

It is the object of the present invention to control or to maintain constant the tension of a yarn over a determined distance without being forced to control and therefore change the feeding speed of the yarn transport devices and without having the possibility of using yarn brake before the section where the yarn tension has to be maintained constant.

In accordance with the present invention, a yarn brake is arranged in the direction of the traveling yarn after the section where the yarn tension has to be kept constant, and the yarn tension is measured before this brake. The control, contrary to the hitherto known processes, has to be carried out inversely, that is, for example, when the measuring feeler signals a rise in the yarn tension in the section to be controlled, the braking effect of the brake has to be increased until the set value of yarn tension in this particular section is attained again. Correspondingly, the braking effect has to be decreased when the yarn tension measured is too low. It has been found that, at constant feeding and draw-off speed of the yarn, the yarn tension after a feeler device can be controlled in a surprisingly simple manner by arranging a brake at the end of the yarn section to be controlled, which brake, in connection with corresponding measuring devices, causes the yarn tension to be maintained constant. Between the yarn brake and the draw-off device, there is a further yarn section the length of which advantageously is determined in such a manner that any overtension eventually occurring by the strict control of the first yarn section can be compensated in this yarn section having an elastic tension.

In case of separation of yarns from hot yarn packages, the brake should be advantageously arranged at a point of the distance traversed by the yarn where the crimped yarn has already cooled to an extent which makes it insensitive to varying tension.

The process of the invention is especially suitable for the control or maintenance of crimped or texturized yarns, because the yarn tension values are below those causing the yarns to lose their crimp. Furthermore, the process of the invention allows also a programmed control of the yarn tension or a control thereof according to further parameters.

The present invention thus provides a process for the control or maintenance of the tension of a traveling yarn or thread over a determined distance, which comprises obtention of the yarn tension by using a Yarn brake after the above distance working in direction of the traveling yarn and being connected with a yarn tension feeler measuring the yarn tension before the brake, which feeler, upon rising tension of the yarn in the controlled section, causes an increase of the braking effect of the yarn brake or, inversely, a decreased braking effect in the case of decreasing yarn tension.

In an advantageous embodiment, the process of the invention is used for the separation under constant tension of yarns from packages of crimped yarn.

Figure 2:
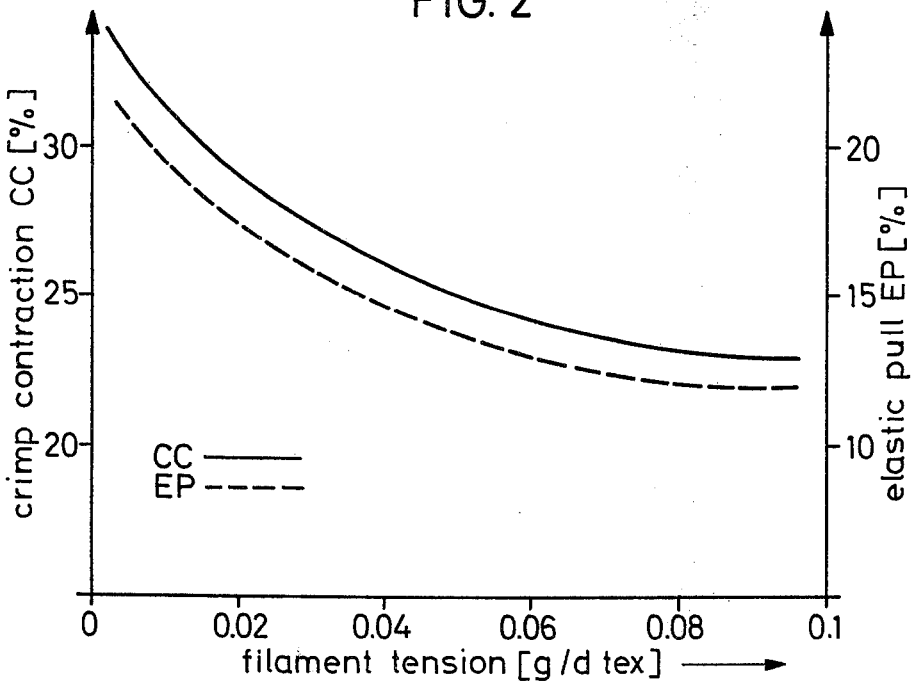

The present invention will be better understood by reference to the drawings, of which FIG. 1 is a schematic representation of the process and suitable equipment, and FIG. 2 (see Example) a yarn tension diagram.

Referring now to FIG. 1, a yarn 1 is forwarded by means of a feeder device 2 at constant speed via a tension-sensitive feeler 3 and a brake 4, and it is drawn off, at constant speed too, by means of a draw-off device 5. The yarn tension before the brake 4 is always lower than after it. The Yarn tension between feeder device and brake must be maintained constant without changing the feeding or draw-off speed. When the yarn tension between the feeder device 2 and the brake 4 rises because of changing yarn properties, the braking factor of the brake must be increased. This is achieved by increasing the looping angle of the yarn 1 around the brake rods 7 by clockwise turning the disk 6 upon which the brake rods 7 are mounted in a fixed position.

The control of the movement of disk 6 may be carried out by means of an electronic control device 8 connected with the tension-sensitive feeler 3. However, also other known operation modes may be used, for example pneumatic control of the position of the brake relative to the values measured by feeler 3, and under favorable conditions, even a direct techanical coupling of the measuring feeler 3 and the adjustable part of the brake 4 may be taken into consideration.

When the yarn tension in the controlled section between the feeder device 2 and the brake 4 rises, the braking factor is increased, thus raising yarn tension and stretch after brake 4. The additional yarn lengthening after brake 4 causes a length excess of the yarn before brake 4, and the yarn is allowed to slacken until the required tension value is attained. Inversely, a too low yarn tension before the brake 4 is compensated by decreasing the braking force of the brake 4.

The process of the invention is especially suitable for controlling the tension of texturized yarn which, because of its crimp, displays considerable difference in length already at a slightly irregular tension. The process of the invention should be preferably applied in cases where the yarn tension occurring before and after the brake does not cause irreversible, undesireable alteration of yarn properties.

The following example illustrates the invention.

EXAMPLE

It is demonstrated that, during the separation of yarn from a hot crimped yarn package, the crimp can be considerably influenced by the choice of yarn tension, so that, in order to attain permanent uniform properties, the yarn tension has to be maintained constant. In a jet stufferbox texturizing plant as described for examle in German Offenlegungsschrift No. 2,036,856, four drawn polyamide-6 carpet yarns having a titer of dtex 1100 f 67 were injected by means of an injector nozzle as described in German Offenlegungsschrift No. 2,217,109, and texturized.

The steam pressures used for texturizing were the following: $p_1 = 5.0$ atm-g, and $p_2 = 1.0$ atm-g (definition of the symbols $p_1$ and $p_2$ see German Offenlegungsschrift No. 2,217,109). $p_1$ and $p_2$ are accordingly arbitrarily preselected. The diameter of the stufferbox was 8 mm. The stuffed yarn leaving the discharge rolls was ejected at a speed of 40 m/min and then immediately separated under appropriate tension; the crimped yarns being forwarded via tension feelers to adjustable brakes according to FIG. 1 and drawn off from there by godets and wound up on winding devices. The yarn tension in the moment of separation from the hot yarn package was modified. The crimp contraction (CC) and elastic pull (EP) values (definiton see German Offenlegungsschrift No. 2,217,109) of the yarns obtained were determined and plotted against the yarn tension in the moment of separation from the package. CC and EP are defined and discussed in U.S. Pat. No. 3,895,420, which corresponds to aforementioned German Offenlegungsschrift 2,277,109, as well as aforementioned $p_1$ and $p_2$. The resulting dependence of these crimp values on the yarn tension in the moment of separation is indicated in FIG. 2. Even when using a tension feeler having only a mechanical effect on the adjustable brake, the chosen tension values could be kept relatively constant within a limit of ± 10%.

FIG. 2 clearly shows that even small absolute changes of yarn tension cause a considerable alteration of crimp values. Therefore, in order to obtain a material having substantially uniform properties, the separation tension is required to be kept absolutely constant. This maintenance of a constant tension can be achieved by means of the process of the invention in a manner ensuring safe operation and extremely small expenditure.

What is claimed is:

1. A process for the control of the tension of a travelling yarn or thread over a determined distance, which comprises supplying the yarn to travel over the predetermined distance at a substantially constant linear speed, obtention of the yarn tension by using a yarn brake after the above distance working in direction of the travelling yarn and being connected with a yarn tension feeler measuring the yarn tension before the brake, drawing off the yarn from the brake at a substantially constant linear speed, measuring the yarn tension by the yarn tension feeler and, upon rising tension of the yarn in the controlled section, increasing the braking effect of the yarn brake, or upon decreasing tension of the yarn in the controlled section, decreasing the braking effect of the yarn brake.

2. The process as claimed in claim 1, wherein the tension of the travelling yarn or thread is maintained substantially constant during the travel over the predetermined section by the constant tension.

3. The process as claimed in claim 1 wherein yarn from packages of crimped yarn is separated into individual yarns during its travel over the predetermined section by the constant tension.

* * * * *